United States Patent [19]

Looper

[11] 4,351,478

[45] Sep. 28, 1982

[54] APPARATUS FOR CLEANING TANKS OR VESSELS

[76] Inventor: Bruce T. Looper, 405 48th St., N.W., Bradenton, Fla. 33529

[21] Appl. No.: 179,094

[22] Filed: Aug. 18, 1980

[51] Int. Cl.[3] ..... B08B 9/08

[52] U.S. Cl. ..... 239/227; 239/248; 239/264; 239/559

[58] Field of Search ..... 239/227, 225, 246, 248, 239/264, 554, 558, 559, 587; 134/167 R, 172, 181, 198; 118/317, 323

[56] References Cited

U.S. PATENT DOCUMENTS

| | | | |
|---|---|---|---|
| Re. 27,612 | 4/1973 | Ruppel et al. . | |
| 1,880,272 | 10/1932 | Panther | 239/587 |
| 2,045,752 | 6/1936 | Butterworth . | |
| 2,082,330 | 6/1937 | Frede et al. . | |
| 2,109,075 | 2/1938 | Ruth . | |
| 2,116,935 | 5/1938 | Richard et al. . | |
| 2,218,625 | 10/1940 | Rudigier . | |
| 2,661,983 | 12/1953 | Endsley | 239/227 |
| 2,661,983 | 12/1953 | Endsley | 239/227 |
| 3,001,534 | 9/1961 | Grant . | |
| 3,319,889 | 5/1967 | Nelson . | |
| 3,420,444 | 1/1969 | Ajnefors . | |
| 3,563,464 | 2/1971 | Doornbos et al. . | |
| 3,595,256 | 7/1971 | Waltman et al. . | |
| 3,601,136 | 8/1971 | Marcham . | |
| 3,645,452 | 2/1972 | Stoeckel et al. | 239/227 |
| 3,645,452 | 2/1972 | Stoeckel et al. | 239/227 |
| 3,764,075 | 10/1973 | Gagliardo . | |
| 3,895,756 | 7/1975 | Jaeger | 239/227 |
| 4,030,513 | 6/1977 | McKenzie . | |
| 4,163,546 | 8/1979 | Morris et al. | 239/227 |
| 4,211,367 | 7/1980 | Allison | 239/227 |

FOREIGN PATENT DOCUMENTS

| | | | |
|---|---|---|---|
| 230074 | 8/1960 | Australia | 118/317 |

OTHER PUBLICATIONS

Lankford, "Tank Car Cleaning System Recovers Acid Sludge, Saves $132,000/Yr.", *Chemical Processing* (Jul. 1978).

"Application Report–Model M-7B Tank Car Cleaner", Bristol Engineering Company (Jul. 21, 1977).

"Technical Description, Bristol Model M-7", Bristol Engineering Company (Apr. 1975).

Catalog 33, "Bristol Automatic Tank and Process Cleaning Systems", Bristol Engineering Company (1974).

*Primary Examiner*—James B. Marbert

*Attorney, Agent, or Firm*—Benjamin P. Reese, II

[57] ABSTRACT

An improved apparatus for cleaning large tanks and vessels, such as automotive and railway tank cars. A support frame has an air motor, a first gear box and a second gear box fixedly mounted thereon. A wash nozzle assembly is pivotedly attached to the support frame for movement in two directions. The air motor is operatively connected to the first gear box which, in turn, is operatively connected to the second gear box. Both the first gear box and the second gear box are operatively connected to the wash nozzle assembly to pivot the wash nozzle assembly in two directions, and thereby, direct cleaning liquid spray jets along both the longitudinal and latitudinal axes of the tank or vessel to be cleaned.

10 Claims, 4 Drawing Figures

APPARATUS FOR CLEANING TANKS OR VESSELS

BACKGROUND OF THE INVENTION

This invention relates to an improved apparatus for cleaning large tanks or vessels, such as, for example, automotive and railway tank cars. A closely related apparatus is disclosed and claimed in U.S. Pat. No. 4,244,523, issued to Bruce T. Hooper on Jan. 13, 1981, for an Apparatus for Cleaning Tanks or Vessels, which is hereby incorporated by reference.

It is imperative in many industrial operations to thoroughly clean the interior surfaces of large tanks or vessels. Such cleaning is usually done by manual labor. But, manual cleaning is a tedious and time consuming task. Furthermore, manual cleaning often exposes the worker to toxic or corrosive substances and vapors and otherwise creates a hazardous environment for the worker. Thus, automatic cleaning apparatus are desirable.

The phosphoric acid industry presents a typical large tank or vessel cleaning situation. Phosphoric acid is shipped in rubber-lined automotive or railway tank cars. Gypsum and other solids precipitate during the period of transportation from the acid manufacturing plant to the ultimate destination. As a result of such precipitation, a sticky, acid-rich sludge is deposited on the sides and bottom of each tank car. Because the amount of sludge present in each tank car is often substantial, standard industry practice is to clean or remove the sludge from the interior surface of each tank car after each round trip made by that car.

The automotive and railway tank cars which are used for phosphoric acid shipments usually are of the single compartment type. Occasionally, phosphoric acid is shipped in tank cars having a plurality of interior compartments. Such tank cars are widely used in other industries, such as the petroleum industry. With such tank cars, a separate access opening is provided for each of the interior compartments. Normally, the access openings of such tank cars are smaller than the access openings of single compartment tank cars.

Various apparatus for cleaning automotive and railway tank cars and other large tanks and vessels are well known in the art. Nevertheless, prior to the Applicant's invention of the apparatus disclosed and claimed in U.S. Pat. No. 4,244,523, known apparatus were either too large or too heavy, or both, for one worker to conveniently move the apparatus from location to location and position it over and in the access opening at the top of the tank or vessel to be cleaned. And, known apparatus were incapable of thoroughly cleaning the entire interior surface of a typical large tank or vessel, such as, for example, an automotive or railway tank car. Furthermore, known apparatus were either too costly to manufacture or cleaned too slowly, or both, for routine cleaning of large tanks and vessels.

The apparatus disclosed and claimed in U.S. Pat. No. 4,244,523 eliminated many of the disadvantages inherent in known apparatus for cleaning large tanks and vessels. That apparatus is both light enough and small enough to enable one worker to conveniently move it from location to location. And, that apparatus is small enough to be positioned over and in the main dome access opening of most single compartment railway tank cars and the access opening of many single compartment automotive tank cars and other large tanks and vessels. With such tanks and vessels, that apparatus is capable of thoroughly cleaning the entire interior surface of the tank or vessel. Furthermore, because it is relatively inexpensive to manufacture and is capable of relatively rapid cleaning, that apparatus is suitable for routine cleaning of such tanks and vessels.

While the apparatus disclosed and claimed in U.S. Pat. No. 4,244,523 has many advantages and benefits, it cannot be used to clean typical multi-compartment automotive tank cars and other large tanks and vessels having relatively small access openings. That apparatus has a tiltable frame, pivotedly mounted to a fixed support frame, and a wash nozzle assembly, pivotedly mounted to the tiltable frame, which are continuously moved to direct cleaning liquid spray jets along two axes of the tank or vessel to be cleaned. It can be appreciated from an examination of FIGS. 3–6 of U.S. Pat. No. 4,244,523 that a relatively large access opening in the tank or vessel to be cleaned is required for continuous movement of both the tiltable frame and the wash nozzle assembly of that apparatus.

It is desirable to have an apparatus which can be used to clean large tanks and vessels having relatively small access openings. It is also desirable to have an apparatus which achieves this capability without sacrificing the advantages which are inherent in the apparatus disclosed and claimed in U.S. Pat. No. 4,244,523.

SUMMARY OF THE INVENTION

The present invention provides an improved apparatus which can be used to clean the interior surfaces of almost all automotive or railway tank cars, whether of the single compartment or multiple compartment type, and many other large tanks and vessels routinely used in industry. The apparatus of the present invention is comprised of five major components, namely, a support frame, a wash nozzle assembly, an air motor, a first gear box and a second gear box. The air motor, first gear box and second gear box are rigidly mounted on the support frame. The wash nozzle assembly is comprised of a flexible cleaning liquid inlet tube and a spray head. Means are provided for attaching the wash nozzle assembly to an elongated vertical member of the support frame in a manner which enables the wash nozzle assembly to be pivoted in two directions.

To position the apparatus for cleaning operations, the wash nozzle assembly is inserted through an access opening of the tank or vessel to be cleaned such that one end of its flexible cleaning liquid inlet tube remains outside the tank or vessel for connection to a source of pressurized cleaning liquid and the support frame rests on that portion of the tank or vessel which is adjacent to the access opening. The air motor is connected to an air compressor or other conventional source of pressurized air by a flexible hose.

During operation of the apparatus, the air motor drives the first gear box which in turn pivots the wash nozzle assembly by means of fly wheel, lever arm and coupling mechanisms. At the same time, the first gear box drives the second gear box to pivot the wash nozzle assembly by lever arm mechanisms. These two continuous pivoting movements direct cleaning liquid spray jets which are emitted from the spray nozzles on the spray head back and forth along both the longitudinal axis and the latitudinal axis of the tank or vessel to be cleaned. These pivoting movements require substantially less space than is required for movement of the wash nozzle assembly and the tiltable frame of the apparatus disclosed and claimed in U.S. Pat. No. 4,244,523 to achieve an equivalent cleaning action.

These and many other advantages, features and objects of the present invention will be apparent from the following brief description of drawings, description of the preferred embodiment and the claims.

DESCRIPTION OF THE PREFERRED EMBODIMENT

Figure 1:
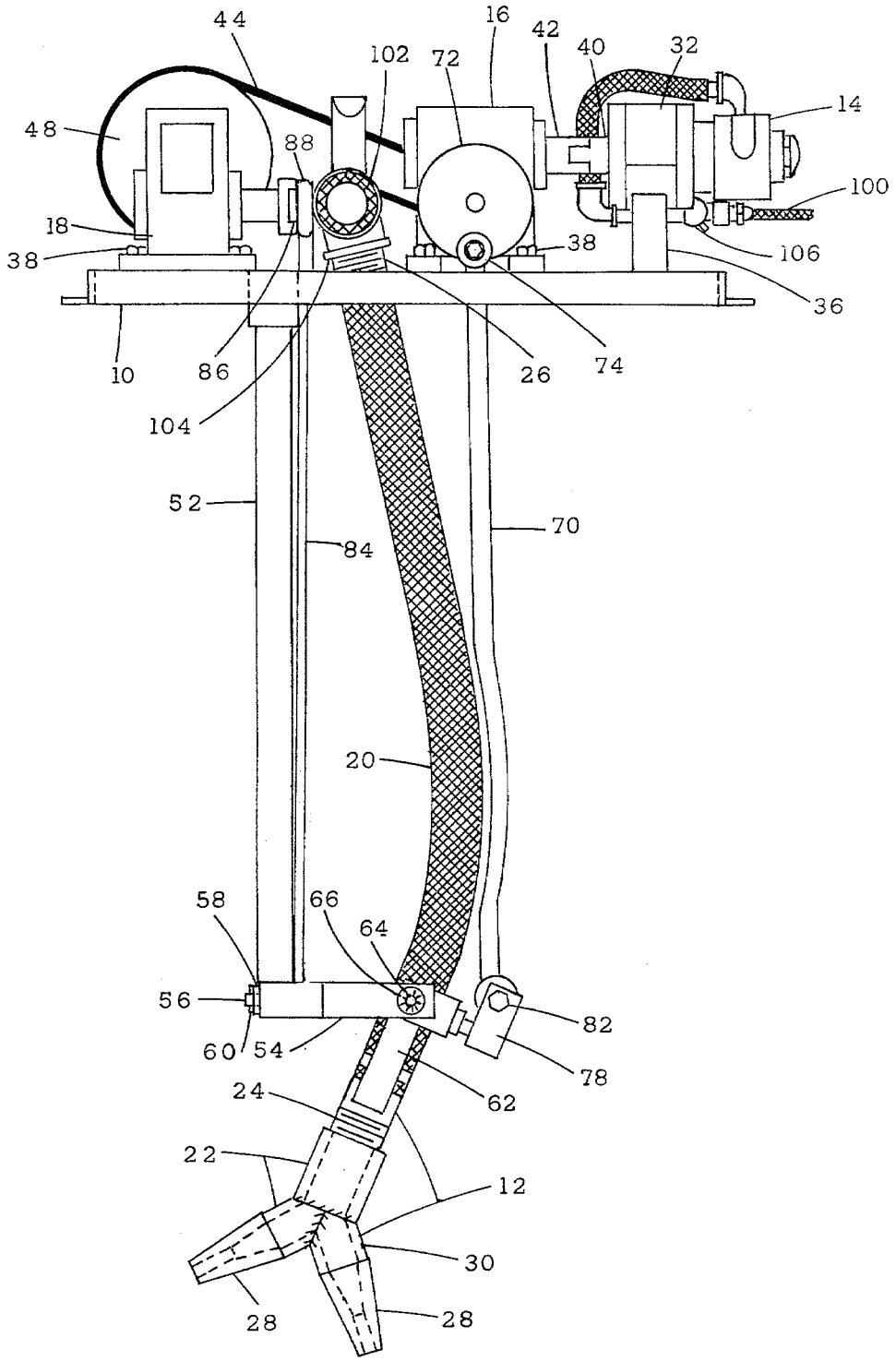
FIG. 1 is an elevational view of the apparatus of the present invention.

The preferred embodiment of the large tank or vessel cleaning apparatus of the present invention is illustrated in FIGS. 1–4. As illustrated, the apparatus is comprised of five major components, namely, a support frame 10, a wash nozzle assembly 12, an air motor 14, a first gear box 16 and a second gear box 18.

Many of the standard shapes available from commercial suppliers of structural steel and other structural alloys are suitable as structural materials for fabrication of the fixed support frame 10. Traditional means for rigidly fastening or joining the individual pieces of the structural material selected can be utilized to fabricate each frame. Welded stainless steel frames having an "L" shaped cross-section are preferred because of their structural characteristics and corrosion resistant characteristics.

The wash nozzle assembly 12 is comprised of a flexible cleaning liquid inlet tube 20 and a spray head 22. Conventional flexible hose or tubing is suitable for fabrication of the flexible cleaning liquid inlet tube 20. Of course, the hose or tubing which is selected must be compatible with the cleaning liquid(s) to be used with the apparatus. The flexible cleaning liquid inlet tube 20 which is illustrated in FIGS. 1–4 is fabricated from an acid resistant reinforced rubber hose. In the preferred embodiment, metal fittings having external screw threads are provided on ends 24 and 26 of the flexible cleaning liquid inlet tube 20.

Figure 2:
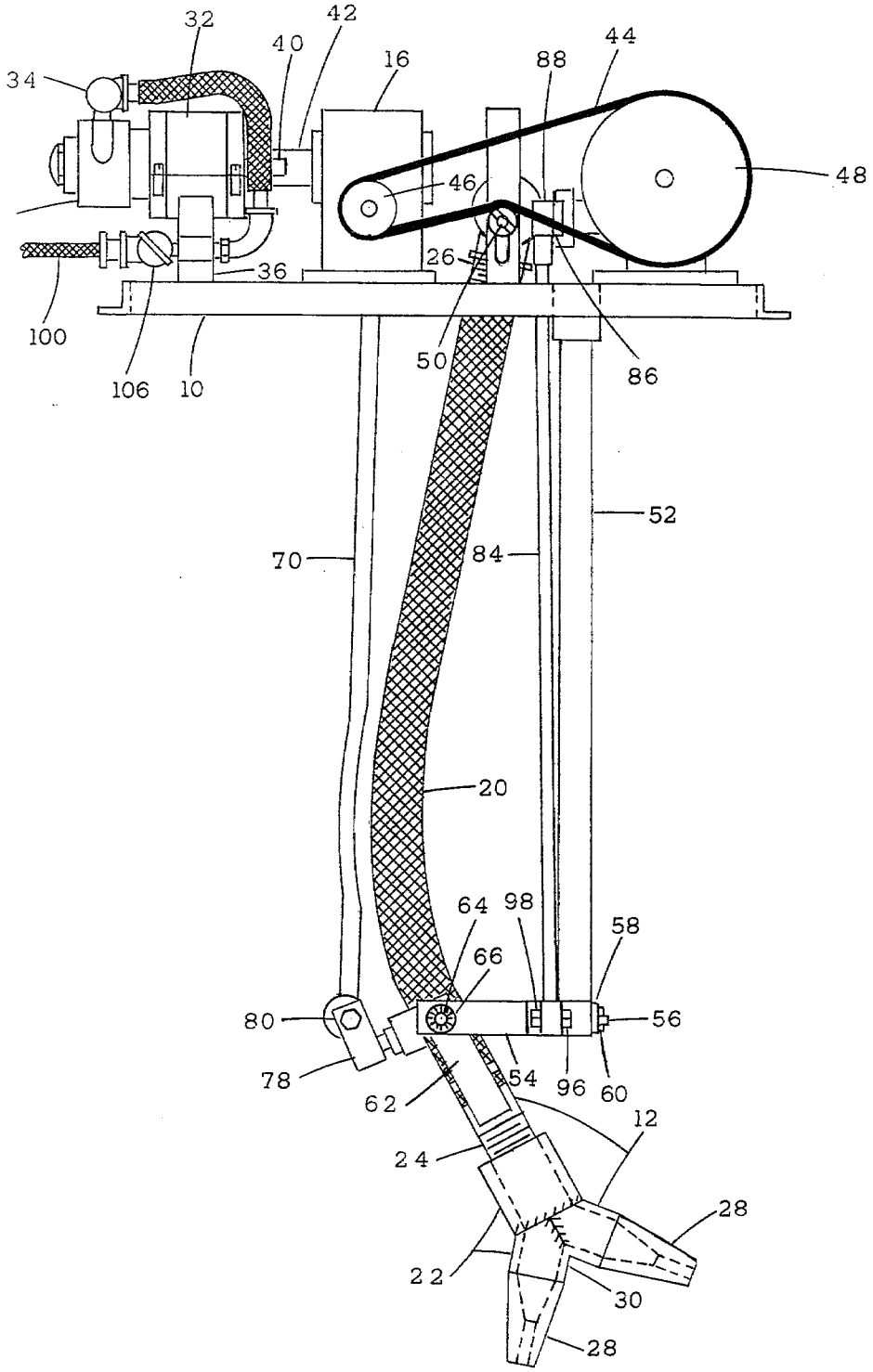
FIG. 2 is an elevational view of the side of the apparatus of the present invention opposite to that shown in FIG. 1.
Figure 3:
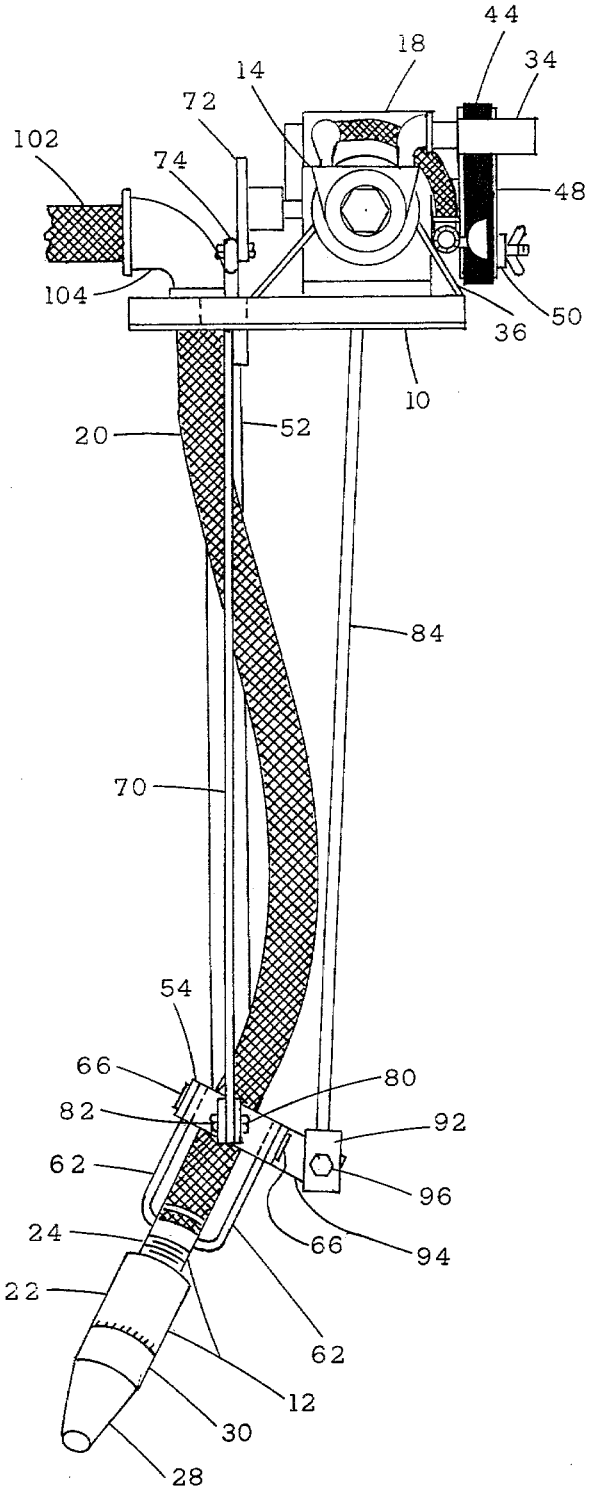
FIG. 3 is an end view of the apparatus of the present invention as seen by viewing the apparatus either from right to left in FIG. 1 or from left to right in FIG. 2.

The design of the particular spray head utilized for cleaning operations is dependent upon the size and shape of the tank or vessel to be cleaned and the nature and location of the material to be removed from that tank or vessel. In the preferred embodiment, one of the two alternate spray heads disclosed in U.S. Pat. No. 4,244,523 or the spray head illustrated in FIGS. 1–4 is utilized. As illustrated, the spray head 22 consists of two spray nozzles 28 and a Y-shaped pipe coupling 30 having internal screw threads. Stainless steel is the preferred material for each of these components. The pipe coupling 30 which is illustrated is fabricated by cutting and welding segments of conventional pipe to achieve the desired Y-shape. Each of the spray jet nozzles 28 is machined from rod or bar stock. Preferably, external threads are provided on one end of each of the spray jet nozzles 28 for engaging the internal threads in two of the openings of the pipe coupling 30. Alternatively, the spray jet nozzles 28 can be welded to the pipe coupling 30 to complete assembly of the spray head 22. As illustrated in FIGS. 1 and 2, the Y-shaped coupling 30 is fabricated to provide an eighty degree angle between the spray jet nozzles 28. The spray head 22 is screwed onto end 24 of the flexible cleaning liquid inlet tube 20 to complete assembly of the wash nozzle assembly 12.

In the preferred embodiment, the air motor 14 is a conventional one-third hp variable speed air motor having a speed reduction gear box 32 with a mid-range output speed of approximately 150 rpm and a muffler 34. If appropriate speed reduction means are utilized, any conventional variable speed air motor can be substituted for the air motor illustrated in FIGS. 1–4. The first gear box 16 is a Sterling Perfection Gear Box, Model Number ST-1360C, or its equivalent. The second gear box 18 is a Sterling Perfection Gear Box, Model Number ST-1360B, or its equivalent. These gear boxes are available from Sterling Power Systems, Inc., 532 East Emaus Street, Middletown, Pa. 17057. Both of these gear boxes have a 60:1 reduction ratio, a 0.09 hp rating at 1750 rpm input, and a 0.05 hp rating at 29.2 rpm output. The first gear box 16 has one input drive shaft and two output drive shafts. The second gear box 18 has one input drive shaft and one output drive shaft.

The air motor 14, the first gear box 16 and the second gear box 18 are fixedly mounted on the support frame 10. Preferably, a support stand 36 is welded to the support frame 10 and the air motor 14 is affixed to the support stand 36 with conventional clamps. And, headed bolts 38 and nuts (not illustrated) are provided for mounting the first gear box 16 and the second gear box 18 to the support frame 10. Alternatively, other traditional fastening means, such as welding, can be utilized to mount each of these components on the support frame 10. A conventional coupling half 40 on the output shaft of the speed reduction gear box 32 engages a conventional coupling half 42 on the input shaft of the first gear box 16 to operatively connect the air motor 14 and the first gear box 16. A flexible belt 44 engages a pulley 46 on the first output shaft of the first gear box 16 and a pulley 48 on the input shaft of the second gear box 18 to operatively connect the first gear box 16 and the second gear box 18. The flexible belt 44 can be loosened or tightened by lowering or raising the adjustable idler 50.

Figure 4:
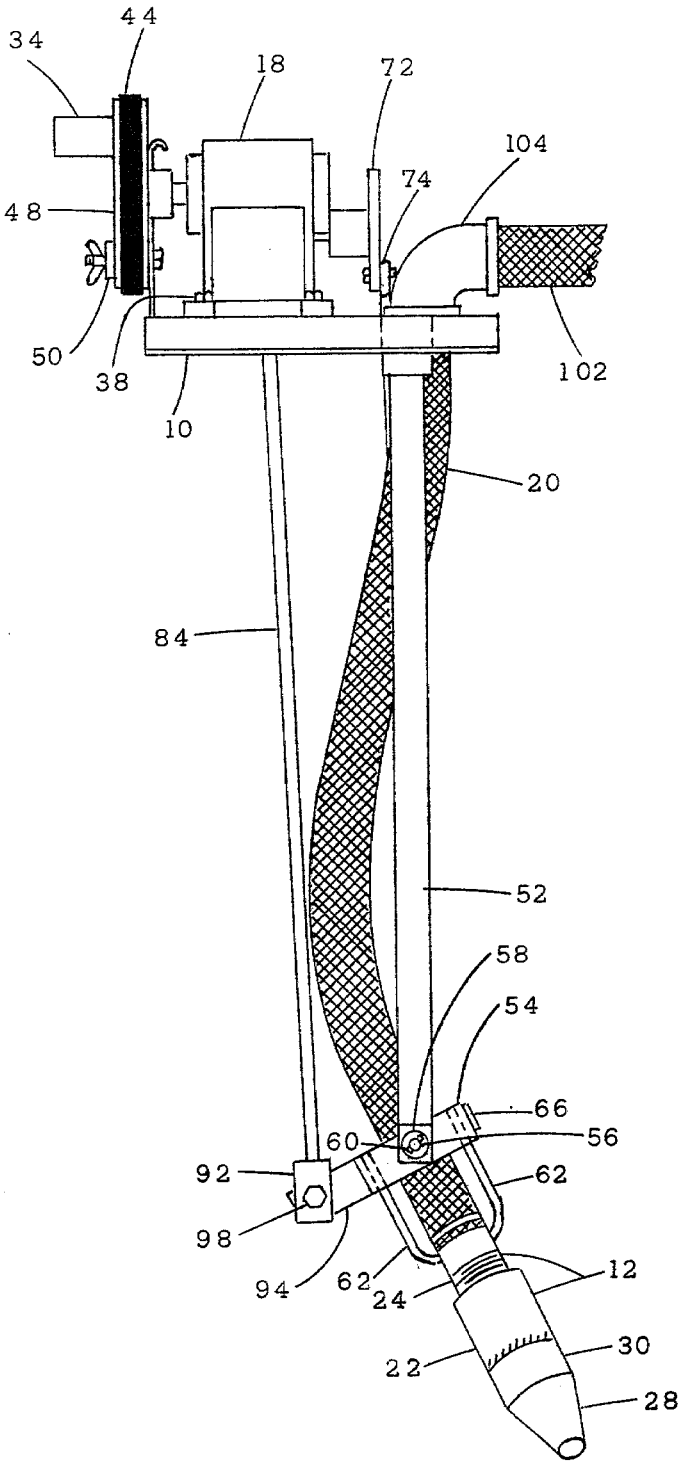
FIG. 4 is an end view of the apparatus of the present invention.

The support frame 10 has an elongated vertical member 52 extending downward for insertion through the access opening of the tank or vessel to be cleaned and into said tank or vessel. The member 52 which is illustrated is welded to the upper portion of the support frame 10. Alternatively, the member 52 can be fastened to the upper portion of the support frame 10 by other conventional means, such as bolts and nuts. Or, the member 52 can be fabricated from a pipe having external threads on one end for engaging an internally threaded coupling which has been welded to the upper portion of the support frame 10. It can be readily appreciated that either the bolt and nut or threaded coupling fastening alternatives would enable the member 52 to be conveniently removed from the support frame 10 when it is desired to package the apparatus for shipment. A yoke 54 is pivotedly attached to the lower end of the member 52 by conventional means. As illustrated in FIGS. 1, 2 and 4, a shaft 56 is welded to the closed end of the yoke 54, passed through a cylindrical hole near the lower end of the member 52, and secured with a conventional washer 58 and pin 60.

The wash nozzle assembly 12 is pivotedly attached to the yoke 54 by conventional means. For example, a pair of brackets 62 can be welded to the metal fitting on the end 24 of the flexible cleaning liquid inlet tube 20. In such case, each of the brackets 62 is provided with a fixed shaft 64 near its free end. Each of the shafts 64 is passed through a cylindrical hole in one prong of the yoke 54. A conventional washer 66 is welded to the free end of each of the shafts 64 to prevent the shaft from disengaging the cylindrical hole. Preferably, the yoke 54, the brackets 62 and all associated hardware are fabricated from stainless steel.

One end of a first elongated lever arm 70 is rotatably fastened to a fly wheel 72 on the second output shaft of the first gear box 16 by conventional means, such as a ball joint 74. The other end of the first elongated lever arm 70 is rotatably fastened to one end of a coupling device 78 by conventional means, such as a headed bolt 80 and a nut 82. In addition to rotational movement in relation to the end of the lever arm 70, the coupling device 78 must be capable of rotational movement around an axis generally perpendicular to the longitudinal axis of the flexible cleaning liquid inlet tube 20. The two-component structure which is illustrated is capable of such motion. Alternatively, a ball and socket coupling would be suitable for use as the coupling device 78. The other end of the coupling device 78 is rigidly fastened to the brackets 62 welded to the metal fitting on the end 24 of the flexible cleaning liquid inlet tube 20 by conventional means, such as welding. In this manner, the first gear box 16 and the wash nozzle assembly 12 are operatively interconnected for continuous movement of the spray head 22 back and forth along the longitudinal axis of the tank or vessel to be cleaned.

One end of a second elongated lever arm 84 is rotatably fastened to a short lever arm 86 on the output shaft of the second gear box 18 by conventional means, such as a ball joint 88. A yoke 92 having a cylindrical hole near the end of each of its prongs is provided on the other end of a second elongated lever arm 84. The yoke 92 is rotatably fastened to a lever arm 94 on the yoke 54 by conventional means, such as a headed bolt 96 and a nut 98. It will be recalled that the yoke 54 is pivotedly attached to the lower end of the elongated vertical member 52. In this manner, the second gear box 18, the wash nozzle assembly 12 and the lower end of the elongated vertical member 52 of the support frame 10 are operatively interconnected for continuous movement of the spray head 22 back and forth along the latitudinal axis of the tank or vessel to be cleaned.

The utilization of the apparatus of the present invention in a typical large tank or vessel cleaning situation, a sludge deposit on the bottom of the interior of a railway tank car, will now be described. To clean such sludge from the interior of a railway tank car, an upper access opening of the tank car is uncovered and the drain located at the bottom center of the tank car is opened. The apparatus is positioned above the access opening and lowered into the opening until the bottom of the support frame 10 engages and rests on that portion of the tank or vessel which is adjacent to the opening. In this position, the spray head 22 of wash nozzle assembly 12 is located in the upper most central interior portion of the tank car. The air motor 14 is connected to a conventional source of pressurized air, such as an air compressor, by a flexible hose 100. Preferably, the source of pressurized air is maintained at a location which is remote from the tank car. The end 16 of the flexible cleaning liquid inlet tube 20 is connected to a conventional source of pressurized cleaning liquid by conventional means, such as a flexible hose 102 having a coupling 104 for attachment to the metal fitting on the end 26.

Operation of the apparatus is begun by opening the valve 106 on the air motor 14 with the wash nozzle assembly 12 in a straight up and down position. During operation, the first gear box 16, by means of the hereinabove described fly wheel, lever arm and coupling mechanisms, pivots the wash nozzle assembly 12 back and forth to direct the cleaning liquid spray jets emitted from the wash nozzles 28 in an overlapping path along the longitudinal axis of the railway tank car. At the same time, the second gear box 18, by means of the hereinabove described lever arm mechanisms, pivots the yoke 54, and thereby, moves the wash nozzle assembly 12 to direct the spray jets along the latitudinal axis of the railway tank car. The combination of these two pivoting movements causes the cleaning liquid spray jets emitted from the wash nozzles 28 to be directed in overlapping paths along the entire length and width of the sludge deposit in the bottom of the tank car. This erodes the sludge and flushes it out of the tank car through its drain.

It will be readily appreciated from an examination of FIGS. 1–4 that the above described pivoting movements require substantially less space than is required for movement of the wash nozzle assembly and the tiltable frame of the apparatus disclosed and claimed in U.S. Pat. No. 4,244,523 to achieve an equivalent cleaning action. For this reason, the apparatus of the present invention can be used to clean the interior surfaces of large tanks and vessels having an access opening of less than one-half the diameter which is required for use of the apparatus disclosed and claimed in U.S. Pat. No. 4,244,523. Accordingly, the apparatus of the present invention can be used to clean the interior surfaces of almost all automotive or railway tank cars, whether of the single compartment or multiple compartment type, and many other large tanks and vessels routinely used in industry. For some cleaning operations, minor changes to the cleaning procedure hereinabove described may be necessary for optimum utilization of the apparatus of the present invention.

While the present invention has been disclosed in connection with the preferred embodiment thereof, it should be understood that there may be other embodiments which fall within the spirit and scope of the invention as defined by the following claims.

I claim:

1. An apparatus for cleaning tanks or vessels, comprising:

(a) a support frame having an air motor, a first gear box and a second gear box mounted thereon;

(b) an elongated vertical member for insertion through the access opening of the tank or vessel to be cleaned, said elongated vertical member having its upper end attached to said support frame;

(c) a wash nozzle assembly pivotedly attached to the lower end of said elongated vertical member for movement in two directions;

(d) a flexible coupling to operatively connect said air motor and said first gear box;

(e) a belt and pulley mechanism for operatively connecting said first gear box and said second gear box;

(f) a lever arm mechanism for operatively connecting said first gear box and said wash nozzle assembly; and (g) a lever arm mechanism for operatively connecting said second gear box and said wash nozzle assembly.

2. An apparatus for cleaning tanks or vessels as recited in claim 1, wherein said wash nozzle assembly is comprised of a flexible cleaning liquid inlet tube and a spray head.

3. An apparatus for cleaning tanks or vessels as recited in claim 2, wherein said spray head has at least one pair of opposed spray jet nozzles.

4. An apparatus for cleaning tanks or vessels as recited in claim 2, wherein said spray head has one pair of opposed spray jet nozzles which emit streams of high pressure cleaning liquid in a vertical plane and with an angle of approximately 80° between said streams.

5. An apparatus for cleaning tanks or vessels, comprising:

(a) a support frame having an air motor, a first gear box and a second gear box mounted thereon;

(b) an elongated vertical member for insertion through the access opening of the tank or vessel to be cleaned, said elongated vertical member having its upper end attached to said support frame;

(c) a yoke pivotedly attached to the lower end of said elongated vertical member;

(d) a flexible cleaning liquid inlet tube having its lower end pivotedly attached to said yoke;

(e) a spray head attached to said lower end of said flexible cleaning liquid inlet tube;

(f) a flexible coupling to operatively connect said air motor and said first gear box;

(g) a belt and pulley mechanism for operatively connecting said first gear box and said second gear box;

(h) a lever arm mechanism for operatively connecting said first gear box and said flexible cleaning liquid inlet tube; and (i) a lever arm mechanism for operatively connecting said second gear box and said yoke.

6. An apparatus for cleaning tanks or vessels as recited in claim 5, wherein said spray head has at least one pair of opposed spray jet nozzles.

7. An apparatus for cleaning tanks or vessels as recited in claim 5, wherein said spray head has one pair of opposed spray jet nozzles which emit streams of high pressure cleaning liquid in a vertical plane and with an angle of approximately 80° between said streams.

8. An apparatus for cleaning tanks or vessels as recited in claim 5, wherein said lever arm mechanism for operatively connecting said first gear box and said flexible cleaning liquid inlet tube comprises a fly wheel on an output shaft of said first gear box, an elongated lever arm having its upper end rotatably fastened to the lower end of said elongated lever arm and rigidly fastened to said lower end of said flexible cleaning liquid inlet tube, said coupling device being capable of rotational movement around an axis generally perpendicular to the longitudinal axis of said flexible cleaning liquid inlet tube.

9. An apparatus for cleaning tanks or vessels as recited in claim 5, wherein said lever arm mechanism for operatively connecting said second gear box and said yoke comprises a short lever arm on an output shaft of said second gear box and an elongated lever arm having its upper end rotatably fastened to said short lever arm and its lower end rotatably fastened to a lever arm on said yoke.

10. An apparatus for cleaning tanks or vessels as recited in claim 1 or 5, wherein said upper end of said elongated vertical member is removeably attached to said support frame.

* * * * *